US005623769A

United States Patent [19]

Hayden

[11] Patent Number: 5,623,769

[45] Date of Patent: Apr. 29, 1997

[54] DEVICE FOR DRYING OBJECTS IN A DRYER OF CLOTHES

[76] Inventor: Richard Hayden, 958 Woodside Village, Ballwin, Mo. 63021

[21] Appl. No.: 594,841

[22] Filed: Jan. 31, 1996

[51] Int. Cl.[6] ..... F26B 19/00

[52] U.S. Cl. ..... 34/61; 34/90; 34/106; 34/239; 248/206.5

[58] Field of Search ..... 34/60, 61, 69, 34/90, 104, 106, 499, 600, 239; 248/206.5, 300, 309.4

[56] References Cited

U.S. PATENT DOCUMENTS

| | | | |
|---|---|---|---|
| 4,702,016 | 10/1987 | Grigsby et al. | 34/33 |
| 4,813,641 | 3/1989 | Wilson | 248/206.2 |
| 5,024,408 | 6/1991 | Magee | 248/206.5 |
| 5,220,734 | 6/1993 | Carver | 34/133 |
| 5,276,979 | 1/1994 | Gordon, Sr. | 34/133 |
| 5,333,393 | 8/1994 | Hill et al. | 34/440 |
| 5,365,675 | 11/1994 | Shabram, Jr. | 34/109 |
| 5,460,305 | 10/1995 | Ahearn | 248/309.4 X |

*Primary Examiner*—Henry A. Bennett
*Assistant Examiner*—Steve Gravini
*Attorney, Agent, or Firm*—Senniger, Powers, Leavitt & Roedel

[57] ABSTRACT

A device for holding an object within a dryer comprises a thin magnetic sheet having an inner surface and an outer surface. The magnetic sheet is flexible to substantially conform to the inner surface of a generally cylindrical dryer drum mounted for rotation in a dryer. The outer surface of the magnetic sheet everywhere engages the inner surface of the drum over substantially the entire area of the outer surface. A connector releasably mounts the object to the magnetic sheet for holding the object on the sheet as the dryer drum rotates.

15 Claims, 2 Drawing Sheets

DEVICE FOR DRYING OBJECTS IN A DRYER OF CLOTHES

BACKGROUND OF THE INVENTION

This invention relates generally to drying shoes, and more particularly to drying shoes in a conventional automatic clothes dryer.

Automatic clothes dryers generally include a stationary frame and outer casing, and a dryer drum within the casing which rotates relative to the stationary frame. The inner surface of the dryer drum defines a drying chamber in which clothes are placed for drying. As the dryer drum rotates, heated air enters the drying chamber to effect heating of the clothes. Vanes extending inward toward the center of the drying chamber are attached to the inner surface of the dryer drum to create a tumbling action of the clothes within the drying chamber. The rotating action of the dryer drum causes the vanes to carry the clothes upward along the inner surface of the dryer drum until the clothes fall.

Many types of shoes, particularly athletic and casual wear shoes, are capable of being dried in such a clothes dryer. It is also known to place common household articles other than clothing in a dryer, such as cloth toys, stuffed animals, baseball caps and the like. The problem with placing shoes or other bulky objects loosely in a dryer is that they are typically heavier than the clothes placed in the dryer. Thus, shoes are repeatedly thrown against the vanes and inner surface of the dryer drum as the drum rotates during operation. This can result in damage to the vanes and inner surface of the dryer drum.

To solve this problem, it is known to provide devices which prevent shoes from tumbling loosely within a dryer. One such device includes a mesh, nylon bag which straps onto the inner surface of the dryer door. When the dryer door is closed, the bag is held to the inner surface of the door, such that shoes placed within the bag are exposed to the heat within the drying chamber without rotating along with the dryer drum. This device is inefficient for drying shoes because it remains stationary relative to the rotating dryer drum. Moving clothes and shoes within the drying chamber circulates the heated air around the clothes to hasten drying. When the shoes remain stationary, as in this device, the advantages associated with moving the shoes within the drying chamber are lost, and thus a longer than necessary drying time is required.

It is also known to provide a device which connects the shoe to the inner surface of the dryer drum as the dryer drum rotates. These devices generally a connector to mount device on the inner surface of the dryer drum, and a means for fastening the shoe(s) within the device. For example, the device disclosed in U.S. Pat. No. 4,702,016 (Grigsby) includes a rectangular shaded platform to which a shoe is fastened by a pair of straps. The platform is seated on top of a rigid channel containing magnets. The rigid channel engages the inner surface of the dryer drum to hold the shoe during drying.

One disadvantage of this device is that the platform does not fit flush against the inner surface of the dryer drum, leaving the possibility that other clothes tumbling within the dryer may get wedged between the platform and the inner surface of the drum, or the possibility that the device may be pulled away from the inner surface of the drum. Also, the channel connecting the platform to the inner surface of the dryer drum is substantially more narrow than the platform. The device is thus unstable and may roll from side-to-side, causing the platform to impact the dryer drum and potentially separate the device from the inner surface of the dryer drum. Another disadvantage is that because the channel is much narrower than the sole of the shoe, the magnets supporting the weight of the shoe must be relatively thick and heavy. This further increases the possibility of damage to the dryer drum if the device breaks loose from the inner surface of the drum during operation.

Another device, described in U.S. Pat. No. 5,220,734 (Carver), uses a pair of separated rigid magnets mounted on the inner surface of the dryer drum. A strap spanning the pair of magnets is attached at each end to a respective magnet. Shoes are placed directly against the inner surface of the dryer drum between the pair of magnets, and the strap is placed over the shoes to hold the shoes against the inner surface of the dryer drum during operation. A disadvantage associated with this device is that clothes tumbling within the dryer may become wedged between the shoes and the strap because the strap does not fit tightly around the shoes. This may result in the clothes not being effectively dried, or even result in the shoes being pulled loose from between the magnets or the magnets being pulled loose from the inner surface of the dryer drum. Additionally, to fully support the weight of the shoes, the magnets must be relatively thick and heavy. This increases the possibility of damage to the inner surface of the dryer drum if the magnets should break loose. Another disadvantage of this device is that it requires two separate pieces. One of the pieces may be lost or misplaced, rendering the other piece inoperable and useless.

There is a need, therefore, for a single-piece device capable of mounting one or more shoes to the inner surface of a dryer drum which will not inhibit the tumbling of loose articles within the drying chamber, which will reduce the possibility of the shoes or the device breaking loose from the inner surface of the dryer drum, which will reduce the possibility of damage to the inner surface of the dryer drum and which will provide a less expensive and more efficient device for drying shoes within a dryer.

SUMMARY OF THE INVENTION

The present invention introduces a new device for holding shoes within a dryer drum mounted for rotation in a dryer. The new device incorporates in direct combination: (1) a thin, flexible magnetic sheet which is capable of conforming to the shape of the inner surface of the dryer drum; and (2) straps connected to the magnetic sheet that wrap closely around the shoe to securably mount the shoe to the magnetic sheet without leaving large gaps between the straps and the shoes. These elements have not heretofore been available in combination. The new device provides for definite improvements over currently used devices. Specifically, this new device will be lightweight, stable, capable of supporting the weight of multiple articles without slipping, or breaking loose from the inner surface of the drum, will be one piece and will be more dependable and convenient to operate.

An important feature of this invention is that it allows the user to mount the shoes to the magnetic sheet before the magnetic sheet is attached to the inner surface of the dryer drum. The user avoids the hassle and strain of bending over and leaning into a drying chamber to arrange the shoes within the device. The shoes are simply mounted to the magnetic sheet before placing the shoes in the dryer, and then the magnetic sheet, with shoes attached, is placed against the inner surface of the dryer drum. Another important feature is that the surface area of the magnetic sheet is greater than the surface area of the bottoms of the shoes mounted on the magnetic sheet. This feature, which was not previously available, allows the magnetic sheet to be sufficiently thin and flexible to conform to the shape of the dryer drum. It also increases the ability of the magnetic sheet to support the weight of the shoes in a stable manner. The magnetic sheet is less likely to break loose from the inner surface of the dryer drum than prior devices.

Among the several objects of this invention may be noted the provision of an improved device for releasably securing shoes in a dryer which prevents the shoes or device from breaking loose from the inner surface of the dryer; the provision of such a device which inhibits articles tumbling loosely within the drying chamber from entangling or snagging on the device or pulling the device loose from the inner surface of the dryer; the provision of such a device which is one piece; the provision of such a device which is capable of securing multiple articles to the inner surface of the dryer drum; the provision of such a device which prevents damage to the inner surface of the dryer drum; the provision of such a device which is readily loaded with shoes and mounted in a dryer; and the provision of such a device which is easy to manufacture and easy to use.

In general, a device of this invention comprises a thin magnetic sheet having an inner surface and an outer surface. The magnetic sheet is flexible to conform to the inner surface of a generally cylindrical dryer drum mounted for rotation in a dryer. The outer surface of the magnetic sheet everywhere engages the inner surface of the drum. A connector releasably mounts the object to the magnetic sheet for holding the object on the sheet as the dryer drum rotates.

Other objects and features will be in part apparent and in part pointed out hereinafter.

BRIEF DESCRIPTION OF THE DRAWINGS

Corresponding parts are indicated by corresponding reference numerals throughout the several views of the drawings.

DETAILED DESCRIPTION OF THE PREFERRED EMBODIMENTS

Figure 1:
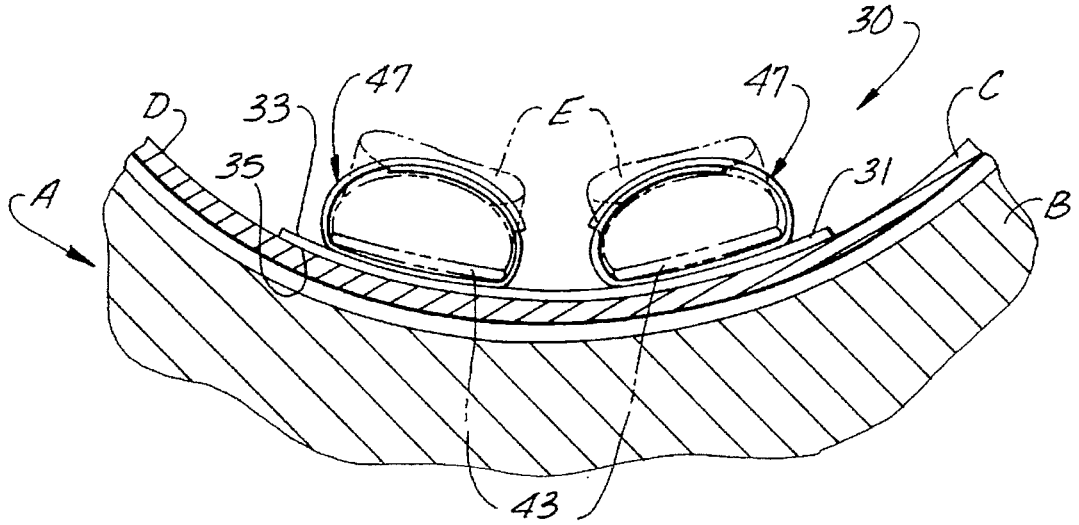
FIG. 1 is a schematic fragmentary cross-sectional view of a dryer with shoes secured within the dryer by a device of this invention.

Now referring to the drawings, specifically FIG. 1, the reference character A refers generally to a dryer. The dryer A has a stationary outer casing B and a dryer drum C having an inner surface D which defines a drying chamber in which objects to be dried are placed. The dryer drum C is mounted for rotation relative to the stationary outer casing B while hot air is blown into the drying chamber to effect drying of the clothes. Rotating the drum creates a tumbling action of the objects placed within the drying chamber to aid in the drying process by moving the clothes past one or more ports (not shown) through which the hot air enters the drying chamber. The dryer drum C contemplated by this invention is made of a ferrous material.

A device constructed according to the principles of this invention for fastening objects, such as a pair of shoes E, to the inner surface D of the dryer drum C, is indicated generally at 30. It is understood, however, that such a device may be used to fasten many other objects to the inner surface D of the dryer drum C, such as clothes, stuffed animals, baseball caps and other objects small enough to fit within the drying chamber. The device 30 comprises a thin, flexible magnetic sheet 31 capable of conforming to the curvature of the inner surface D of the dryer drum C. The magnetic sheet 31 includes an inner surface 33 on which shoes E are mounted for drying, and an outer surface 35 for attaching the device 30 to the dryer drum C. The magnetic sheet 31 conforms to the curvature of the inner surface D of the dryer drum C such that substantially the entire outer surface 35 of the magnetic sheet contacts the inner surface of the dryer drum. The outer surface 35 of the magnetic sheet 31 is exposed, so that when the device is placed in the drying chamber, the outer surface of the magnetic sheet attaches to the inner surface D of the dryer drum C. To assure adequate flexibility of the thin magnetic sheet 31 without sacrificing structural integrity, the thickness of the magnetic sheet should preferably fall within the range of 1/32 inches to 1/8 inches. The preferred thickness of the magnetic sheet 31 is 1/16 inches. It is understood, however, that the magnetic sheet 31 may be of other thicknesses and remain within the scope of this invention, as long as the sheet is sufficiently flexible to conform to the curvature of the inner surface D of the dryer drum C.

The magnetic sheet 31 shown in FIGS. 1–4 is square, having a front edge 37, rear edge 39 and side edges 41, and is adapted to hold a pair of shoes E in spaced, generally parallel relationship. The length and width of the magnetic sheet 31 are preferably dimensioned such that the surface area of the inner surface 33 of the sheet is greater than the surface area of the bottoms 43 of the shoes E mounted on the magnetic sheet. When the shoes E are mounted on the inner surface 33 of the magnetic sheet 31, the bottom 43 of the shoe rests on the inner surface of the magnetic sheet without extending beyond the edges 37, 39, 41 of the sheet. Providing the magnetic sheet 31 with a surface area greater than the surface area of the bottom 43 of the shoes E mounted thereon provides a greater surface area over which the weight of the shoes is distributed, allowing for a reduced thickness of the magnetic sheet while retaining sufficient support to hold the weight of the shoes against the inner surface D of the dryer drum C. Providing a greater surface area also prevents articles tumbling loosely within the drying chamber from lodging between the shoes E and the dryer drum C, pulling the shoes loose or pulling the magnetic sheet 31 off of the inner surface D of the dryer drum C. The thickness to width ratio of the magnetic sheet 31 should preferably be within the range of 0.003 to 0.025. A preferred thickness to width ratio of the magnetic sheet 31 of 0.005 inches allows for adequate flexibility of the magnetic sheet and considerable support for a pair of shoes E mounted on the magnetic sheet. It is understood that the magnetic sheet 31 may be of any shape, length and width and fall within the scope of the present invention.

Figure 3:
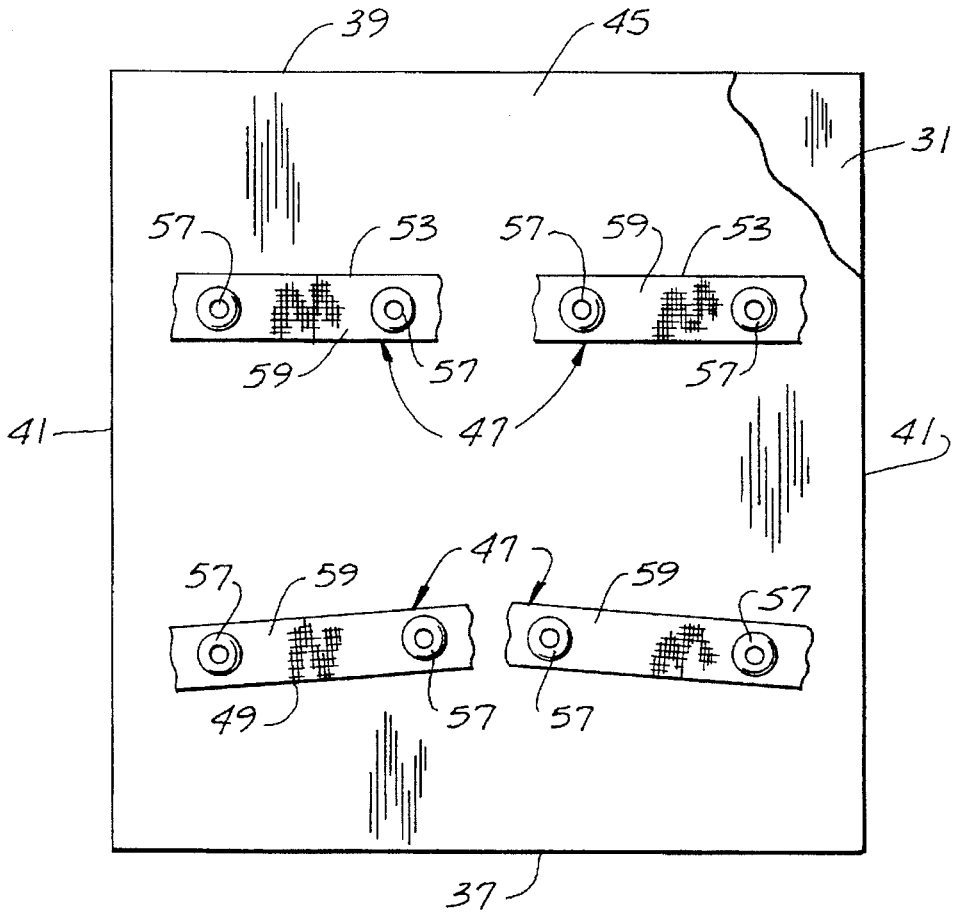
FIG. 3 is a top view of the device with parts broken away to show details of construction.

As best seen in FIG. 3, the inner surface 33 of the magnetic sheet 31 is preferably covered by a thin film 45 of non-ferrous material, such as heat-resistant plastic or vinyl. The thin layer of film provides a number of advantages, including preventing clothes or other objects containing ferrous materials, such as buttons or zippers, tumbling loosely within the dryer A from scratching the magnetic sheet 31; decreasing the risk of cracking of the magnetic sheet caused by repeated drying cycles; and providing a decorative surface for the magnetic sheet.

Each shoe E is mounted on the magnetic sheet 31 by a pair of straps 47. The straps 47 contemplated by this invention may be of any non-ferrous flexible material, and may also be elastic. A toe strap 49 wraps around the toe portion F of the shoe E and a heel strap 53 wraps around the heel portion G of the shoe. It is understood, however, that smaller shoes, such as children's shoes, may be mounted using only one strap and still fall within the scope of this invention. Referring to FIG. 3, each strap 47 is connected to the magnetic sheet 31 by a pair of grommets 57. Using more than one grommet 57 to connect the strap to the magnetic sheet 31 provides the advantages of distributing the loads applied to the strap 47 by the shoe E to more than one location. This reduces the possibility of a grommet 57 breaking away from the magnetic sheet 31 and releasing the strap 47.

The grommets 57 are spaced apart such that when the straps 47 are connected to the magnetic sheet 31, each strap defines a central portion 59 and opposing first and second end portions 61, 63. The central portion 59 is generally that portion of the strap 47 lying between the pair of grommets 57, and the first and second end portions 61, 63 are the remaining strap portions which extend outwardly away from the grommets 57. The spacing between the grommets 57 is preferably greater than the width of the shoe E being held by the straps 47. When the straps 47 are fastened over the shoe E, the tension in the straps retains the shoe between the fixed grommet 57 locations, providing a stable mounting of the shoe to the magnetic sheet 31 during rotation of the dryer drum C. It is understood, however, that any number of grommets 57, including a single grommet, may be used to connect each strap 47 to the magnetic sheet 31 and remain within the scope of the invention. It is also understood that connectors other than grommets 57, such as buttons, glue, thread and the like are contemplated to be within the scope of this invention.

Figure 2:
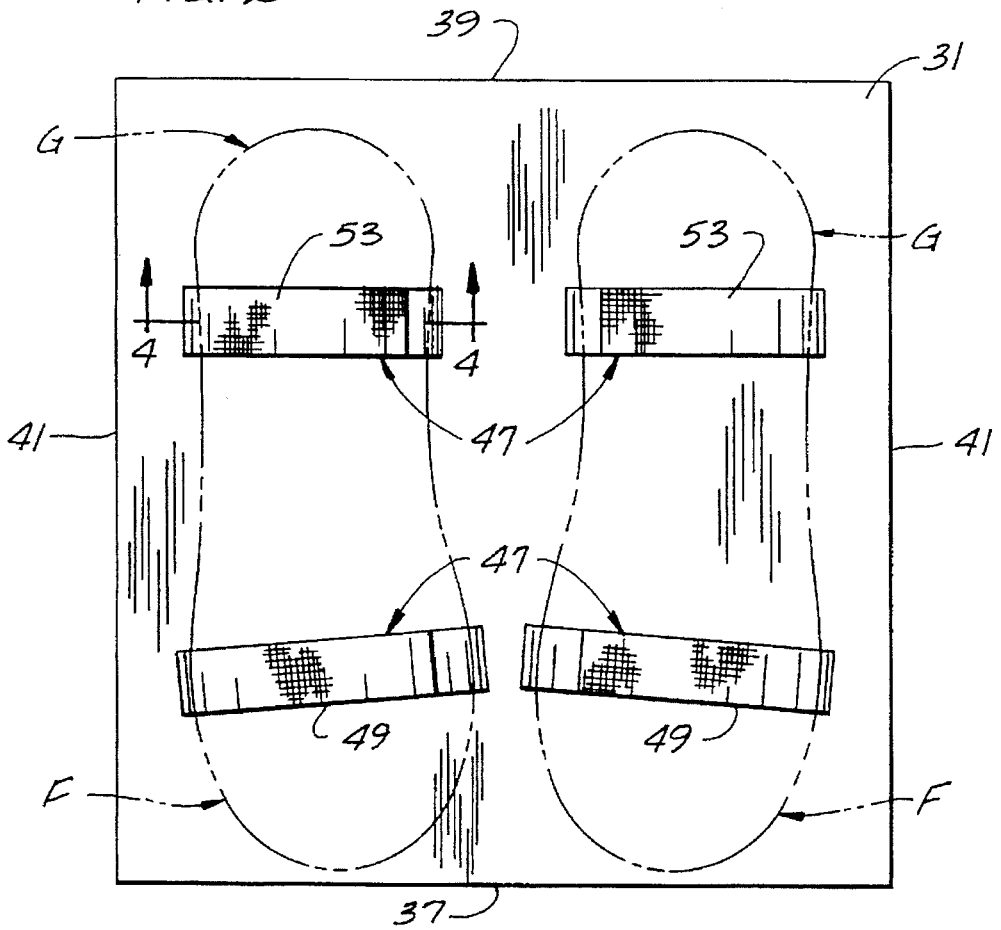
FIG. 2 is a top view of the device showing in phantom a pair of shoes mounted on the device.

The grommets 57 connecting each heel strap 53 to the magnetic sheet 31 are aligned such that the central portion 59 of the heel strap 53 between the grommets lies transverse to the heel portion G of the shoe. As shown in FIG. 3, the preferred placement of the grommets 57 connecting each heel strap 53 is in parallel alignment with the rear edge 39 of the magnetic sheet 31. The grommets 57 are spaced to account for the generally narrow width of the heel portions G of the shoes E with respect to the toe portions F. The grommets 57 used for connecting each toe strap 49 to the magnetic sheet 31 are aligned such that the central portion 59 of the toe strap 49 lies at an angle relative to the central portion 59 of the heel strap 53 to account for the generally asymmetric curvature of the toe portion F of the shoe E. This allows the toe strap 49 to better adapt to the shape of the toe portion F of the shoe as the strap is fastened over the shoe. As shown in FIG. 3, the preferred placement of the grommets 57 connecting each toe strap 49 to the magnetic sheet 31 is such that the central portion 59 of the toe strap is at an angle with respect to the front edge 37 of the magnetic sheet 31. The grommets 57 are more widely spaced than the grommets which connect the heel strap 53 to account for the generally wider toe portions F of the shoes E. For mounting the pair of shoes E in spaced parallel relationship on the magnetic sheet 31, as shown in FIG. 2, it is important that the grommets 57 for mounting one shoe are sufficiently spaced apart from the grommets used in mounting the other shoe. If the grommets 57 are too close, cracking of the magnetic sheet 31 may occur in the area between the shoes E, due to the straps pulling the grommets outward as loads are applied to the straps. In the preferred embodiment, the grommets 57 connecting the toe straps 49 to the magnetic sheet 31 are spaced one inch apart, while the grommets connecting the heel straps 53 to the magnetic sheet are spaced two inches apart.

Figure 4:
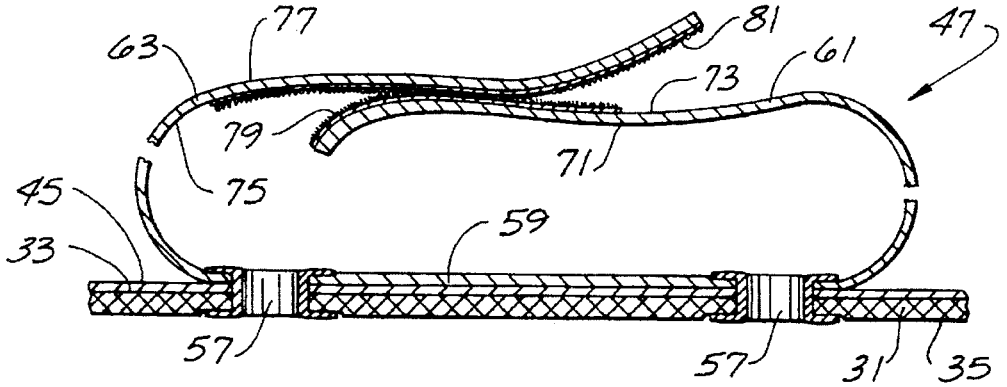
FIG. 4 is a section taken in the plane including line 4—4 of FIG. 2.

The end portions 61, 63 of each strap 47 include elements of a fastener by which the end portions are fastened together for mounting the shoe E on the magnetic sheet 31. The preferred fastener shown in FIG. 4 is a hook-and-loop fastener. Each of the first and second end portions 61, 63 of the strap 47 has an inner surface 71, 75 and an outer surface 73, 77 respectively. The inner surface 71, of the first end portion 61 is smooth, while the outer surface 73 of the first end portion 61 is lined with a dense arrangement of loops 79 comprising the loop element of the hook-and-loop fastener. The outer surface 77 of the second end portion 63 is smooth, while the inner surface 75 of the second end portion 63 is lined with a dense arrangement of hooks 81 comprising the hook element of the hook-and-loop fastener. When fastening the first and second end portions 61, 63 together, the inner surface 75 of the second end portion 63 covers the outer surface 73 of the first end portion 61 and the end portions are then pressed together so that the hooks 81 intermingle with the loops 79 to secure the first and second end portions together. The second end portion 63 is preferably longer than the first end portion 61, so that when the end portions are fastened together, the arrangement of loops 79 on the inner surface 75 of the second end portion covers the entire arrangement of hooks 81 on the outer surface 73 of the first end portion. Thus, none of the hooks 81 are exposed to the clothes tumbling loosely within the drying chamber. Covering the hooks 81 on the outer surface 73 of the first 61 end portion prevents clothes tumbling loosely within the dryer A from snagging or attaching to the fastener. It is understood that various types of fasteners may be used to fasten the first and second end portions 61, 63 together and still remain within the scope of the invention.

In operation, the device 30 is laid on a flat surface so that the magnetic sheet 31 is unbent, as shown in FIG. 2. The central portion 59 of each strap 47 will lie flat against the magnetic sheet 31. The end portions 61, 63 of the strap 47 are unfastened and spread apart. As shown in FIG. 1, the shoe E is set upright on the magnetic sheet 31 so that the sole on the bottom of the shoe rests on the inner surface 33 of the magnetic sheet. As best seen in FIG. 4, the toe portion F of the shoe E extends across the central portion 59 of the toe strap 49 and the heel portion G of the shoe extends across the central portion 59 of the corresponding heel strap 53. The end portions 61, 63 of each strap 47 are pulled up and around the sides of the shoes E and fastened together over the tops of the shoes. The magnetic sheet 31, with shoes E mounted thereon, is then placed along the inner surface D of the dryer drum C, as shown in FIG. 1, so that the entire outer surface 35 of the magnetic sheet attaches to the inner surface of the dryer drum. The dryer A is then cycled to effect drying of the shoes E.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed:

1. A device for holding an object within a generally cylindrical dryer drum mounted for rotation in a dryer, the dryer drum having a curved inner surface defining a drying chamber, the device comprising:

a thin magnetic sheet having an inner surface and an outer surface, the magnetic sheet being flexible to substantially conform to a portion of the curved inner surface of the dryer drum whereby the outer surface of the magnetic sheet engages the inner surface of the drum over substantially the entire area of the outer surface of the magnetic sheet, and a connector for releasably mounting the object on the magnetic sheet for holding the object on the sheet as the dryer drum rotates;

the flexible magnetic sheet and connector being constructed and arranged to hold the object on the dryer drum with the magnetic sheet interposed between the object and the portion of the curved inner surface of the dryer drum to which the magnetic sheet conforms.

2. A device as set forth in claim 1 wherein the magnetic sheet has a magnetic strength sufficient to support its own weight and that of the object connected thereto.

3. A device as set forth in claim 1 wherein the thickness of the magnetic sheet is less than ⅛ inches.

4. A device as set forth in claim 1 wherein the thickness to width ratio of the magnetic sheet is less than 0.025.

5. A device as set forth in claim 1 wherein the connector is constructed for releasably mounting the object on the inner surface of the magnetic sheet.

6. A device as set forth in claim 5 wherein the connector comprises a strap and means for connecting the strap to the inner surface of the magnetic sheet.

7. A device as set forth in claim 6 wherein the strap has a central portion and opposing first and second end portions, the central portion of the strap being connected to the magnetic sheet by said means for connecting the strap to the magnetic sheet, the device further comprising a fastener for fastening the first and second end portions together.

8. A device as set forth in claim 7 wherein said means for connecting the strap to the magnetic sheet comprises a pair of spaced apart strap fasteners.

9. A device as set forth in claim 8 wherein the strap fasteners are grommets.

10. A device as set forth in claim 8 wherein the central portion of the strap is that portion of the strap lying between the strap fasteners, the central portion of the strap lying substantially flat against the inner surface of the magnetic sheet.

11. A device as set forth in claim 7 wherein the fastener for fastening the first and second end portions together comprises a hook and loop fastener including a first fastener element associated with the first end portion and a second fastener element associated with the second end portion.

12. A device as set forth in claim 11 wherein the first and second end portions each have an inner and outer surface, the first fastener element being disposed on the outer surface of the first end portion, and the second fastener element being disposed on the inner surface of the second end portion, the outer surface of the second end portion being everywhere free of any hook and loop fastener element, the second end portion being substantially longer than the first end portion such that the inner surface of the second end portion covers substantially the entire outer surface of the first end portion when the first and second ends are fastened together thereby to prevent articles in the dryer drum from contacting the hook and loop fastener.

13. A device as set forth in claim 12, wherein at least two pair of straps are connected to the inner surface of the magnetic sheet such that at least a pair of objects may be releasably connected to the magnetic sheet.

14. A device as set forth in claim 1 wherein the magnetic sheet is sized and shaped to everywhere underlie and be interposed between the object and the inner surface of the dryer drum to which the magnetic sheet conforms when the connector mounts the object on the magnetic sheet in the dryer drum.

15. A device as set forth in claim 1 wherein the connector is constructed to extend from a first location on the magnetic sheet over the object to a second location on the magnetic sheet thereby to mount the object on the magnetic sheet, the magnetic sheet being everywhere disposed between the connector and the inner surface of the dryer drum to which the magnetic sheet conforms when holding an object within the dryer drum.

* * * * *